US012338511B2

(12) United States Patent
Aoyama et al.

(10) Patent No.: US 12,338,511 B2
(45) Date of Patent: Jun. 24, 2025

(54) ALUMINUM ALLOY DIECAST, DIECAST UNIT AND METHOD FOR PRODUCING SAME

(71) Applicant: Ahresty Corporation, Toyohashi (JP)

(72) Inventors: Shunzo Aoyama, Toyohashi (JP); Kazuki Sasaki, Toyohashi (JP); Yoshiteru Kondo, Toyohashi (JP)

(73) Assignee: AHRESTY CORPORATION, Toyohashi (JP)

( * ) Notice: Subject to any disclaimer, the term of this patent is extended or adjusted under 35 U.S.C. 154(b) by 599 days.

(21) Appl. No.: 17/765,062

(22) PCT Filed: Oct. 1, 2019

(86) PCT No.: PCT/JP2019/038761
§ 371 (c)(1),
(2) Date: Mar. 30, 2022

(87) PCT Pub. No.: WO2021/064865
PCT Pub. Date: Apr. 8, 2021

(65) Prior Publication Data
US 2022/0341005 A1 Oct. 27, 2022

(51) Int. Cl.

| | |
|---|---|
| ***C22C 21/02*** | (2006.01) |
| ***C22C 21/08*** | (2006.01) |
| ***C22C 22/00*** | (2006.01) |
| ***C22F 1/043*** | (2006.01) |
| ***C22F 1/047*** | (2006.01) |

(52) U.S. Cl.
CPC ..... *C22C 21/08* (2013.01); *C22C 21/02* (2013.01); *C22C 22/00* (2013.01); *C22F 1/043* (2013.01); *C22F 1/047* (2013.01)

(58) Field of Classification Search
CPC ..... C22C 21/02; C22C 21/08; C22C 22/00; C22F 1/047; C22F 1/053; C22F 1/043
See application file for complete search history.

(56) References Cited

U.S. PATENT DOCUMENTS

| | | | | |
|---|---|---|---|---|
| 2006/0137774 | A1* | 6/2006 | Nagasaka | C22C 21/08 148/440 |
| 2014/0290064 | A1 | 10/2014 | Smeyers et al. | |
| 2017/0044637 | A1 | 2/2017 | Campbell et al. | |

FOREIGN PATENT DOCUMENTS

| | | | |
|---|---|---|---|
| CN | 106425068 | A | 2/2017 |
| JP | 4-221048 | A | 8/1992 |
| JP | 2000-54047 | A | 2/2000 |
| JP | 2007-2281 | A | 1/2007 |
| JP | 2010-90459 | A | 4/2010 |
| KR | 20160145257 | A | 12/2016 |

OTHER PUBLICATIONS

Notification of Transmittal of Translation of the International Preliminary Report on Patentability (Form PCT/IB/338) issued in counterpart International application No. PCT/JP2019/038761 mailed Apr. 14, 2022 with Forms PCT/IB/373 and PCT/ISA/237. (6 pages).
English Translation of Written Opinion dated Dec. 24, 2019, issued in counterpart International application No. PCT/JP2019/038761. (4 pages).
International Search Report dated Dec. 24, 2019, issued in counterpart International Application No. PCT/JP2019/038761 (2 pages).
Written Opinion in Japanese dated Dec. 24, 2019, issued in counterpart International Application No. PCT/JP2019/038761 (3 pages).
Office Action dated Jul. 27, 2022, issued in counterpart IN Application No. 202217013894, with English translation. (6 pages).
Office Action dated Mar. 26, 2024, issued in counterpart CN Application No. 201980100828.5, with English translation. (13 pages).

* cited by examiner

*Primary Examiner* — Jessee R Roe
(74) *Attorney, Agent, or Firm* — WHDA, LLP

(57) ABSTRACT

Provided is an aluminum alloy diecast that can be unlikely to crack at a part to be press-fitted while the proof stress of a main body part is being secured, and can eliminate the need for heat treatment to the main body part at the time of production. The aluminum alloy diecast (11) includes a part to be press-fitted (13) into which a joining member (20) is press-fitted and a main body part (14) in which the part to be press-fitted (13) is integrally formed, in which an average hardness of the part to be press-fitted (13) is lower than an average hardness of the main body part (14) or an average roundness of crystals other than a primary crystal of Al in the part to be press-fitted (13) is larger than an average roundness of crystals other than a primary crystal of Al in the main body part (14).

8 Claims, 3 Drawing Sheets

ALUMINUM ALLOY DIECAST, DIECAST UNIT AND METHOD FOR PRODUCING SAME

TECHNICAL FIELD

The present invention relates to an aluminum alloy diecast into which a joining member is press-fitted, a diecast unit in which the joining member is fixed to the aluminum alloy diecast and a method for producing the same.

BACKGROUND ART

For example, in the case where a part of the steel plate of an automobile body is replaced with an aluminum alloy diecast in order to reduce the weight of the automobile body, the steel plate and the aluminum alloy diecast are required to be joined. Joining dissimilar metals by spot welding or the like results in forming brittle intermetallic compounds. Therefore, the joining member such as a self-piercing rivet may be press-fitted into the overlapped part of the steel plate and the aluminum alloy diecast to mechanically join the steel plate and the aluminum alloy diecast.

As described above, when the joining member is press-fitted onto the surface of a part to be press-fitted of the aluminum alloy diecast to produce a diecast unit, the back surface of the part to be press-fitted causes elongation deformation. Although depending on the composition or the like of the aluminum alloy, cracks may be generated on the back surface of the part to be press-fitted. Patent Literature 1 has described that heat treatment is applied to the aluminum alloy diecast after casting to improve the ductility of the aluminum alloy diecast, whereby the back surface of the part to be press-fitted is unlikely to generate the cracks. In Patent Literature 1, heat treatment in which the aluminum alloy diecast after casting is retained at 460° C. to 500° C. for 0.25 hours to 1.5 hours to cool by air and thereafter retained at 190° C. for 3 hours is performed.

CITATION LIST

Patent Literature

Patent Literature 1: Japanese Patent Application Laid-Open Publication No. 2010-90459

SUMMARY OF INVENTION

Technical Problem

However, in the case where the heat treatment (solution treatment) is applied to, for example, the entire aluminum alloy diecast having relatively large size used for the automobile body under the heat treatment conditions as the above-described conventional technique, the aluminum alloy diecast may be fixed to a jig that prevents the deformation of the aluminum alloy diecast associated with the heat treatment, which may require a large heat treatment space. The aluminum alloy diecast particularly used for vehicles with a large number of production may require a large heat treatment furnace in which heat treatment is applied to many aluminum alloy diecasts or may require a large building for arranging the heat treatment furnace. There arise problems in that the heat energy required to heat a main body part is wasted when the main body part of the aluminum alloy diecast other than the part to be press-fitted is heated or a large-scale facility for heating the entire aluminum alloy diecast is required as described above.

In the case where gas is inserted inside the main body part by casting, blisters may be generated in the main body part when the main body part is heated. Therefore, the aluminum alloy diecast is casted by a special diecasting method such as a high vacuum diecasting method or the amount of mold release agent or the like to be used that evaporates to become gas may be required to be reduced so that the gas is not inserted in the main body part by casting. The main body part may be deformed at the time of heating the main body part and thus the main body part may be required to be held with a jig for preventing the deformation at the time of heating or a process of correcting the deformation of the main body part after heating may be required. In order to prevent the main body part from being deformed at the time of cooling (quenching) after heating, the aluminum alloy diecast after heating may not be cooled with water but blast cooling in which the aluminum alloy diecast is cooled by colliding a large amount of air may be used in some cases. In addition, there arise problems in that the ductility of the heated main body part may be improved and thus the proof stress of the main body part may be deteriorated.

The present invention has been made to solve the above-described problems and an object of the present invention is to provide an aluminum alloy diecast that can be unlikely to generate cracks at the part to be press-fitted while the proof stress of the main body part is being secured, and at the same time, can eliminate the need for heat treatment to the main body part at the time of production, a diecast unit and a method for producing the same.

Solution to Problem

In order to achieve this object, the aluminum alloy diecast of the present invention is an aluminum alloy diecast made of an aluminum alloy comprising 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities, the aluminum alloy diecast comprising: a part to be press-fitted having a press-fitted front surface onto which a joining member is press-fitted and a press-fitted back surface located at an opposition side of the press-fitted front surface; and a main body part having a main body front surface connected to an edge of the press-fitted front surface and a main body back surface connected to an edge of the press-fitted back surface and integrally formed with the part to be press-fitted, wherein an average hardness of the part to be press-fitted obtained by averaging Rockwell hardness HRF of the press-fitted back surface is lower than an average hardness of the main body part obtained by averaging Rockwell hardness HRF of the main body front surface or the main body back surface.

In addition, the aluminum alloy diecast of the present invention is an aluminum alloy diecast made of an aluminum alloy comprising 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities, the aluminum alloy diecast comprising: a part to be press-fitted having a press-fitted front surface onto which a joining member is press-fitted and a press-fitted back surface located at an opposition side of the press-fitted front surface; and a main body part having a main body front surface connected to an edge of the press-fitted front surface and a main body back surface connected to an edge of the press-fitted back surface and integrally formed with the part to be press-fitted, wherein an average roundness of crystals other than a primary crystal of Al in the part to be press-fitted in a range of 0.02 mm to 0.5 mm in a depth from the press-fitted back surface is larger than an average roundness of crystals other than a primary crystal of Al in the main part in a range of 0.02 mm to 0.5 mm in a depth from the main body front surface or the main body back surface.

In addition, the method for producing the diecast unit of the present invention is method for producing a diecast unit comprising an aluminum alloy diecast made of an aluminum alloy comprising 7.5% to 11.5% of Si, 0.1% to 0.6% of Mg, 0.2% to 0.9% of Mn, 0.2% or less of Ti, 0.1% or less of Sr and a remainder made of Al and inevitable impurities and a joining member press-fitted onto a press-fitted front surface of the aluminum alloy diecast, the method comprising: a heating step of heating a part of the aluminum alloy diecast and terminating the heating when a center of a press-fitted back surface opposite to the press-fitted front surface in the heated part reaches 420° C. or higher to determine the heated part as a part to be press-fitted; and a press-fitting step of press-fitting the joining part onto the press-fitted front surface of the part to be press-fitted within a predetermined time after the heating step to cause the elongation deformation of the press-fitted back surface of the part to be press-fitted.

The aluminum alloy diecast of the present invention may satisfy both of the lower average hardness of the part to be press-fitted than the average hardness of the main body part and the larger average roundness of the crystals other than the primary crystal of Al of the part to be press-fitted than the average roundness of the crystals other than the primary crystal of Al of the main body part.

Advantageous Effects of Invention

In the aluminum alloy diecast as claimed in claim 1, the average hardness of the part to be press-fitted obtained by averaging the Rockwell hardness HRF of the press-fitted back surface is lower than the average hardness of the main body part obtained by averaging the Rockwell hardness HRF of the main body front surface or the main body back surface. Basically, the lower the average hardness is, the higher the ductility of the object is. Therefore, in the case where the joining member is press-fitted into the part to be press-fitted to elongate the part to be press-fitted, the part to be press-fitted can be unlikely to generate cracks. The ductility of the main body part is lower than the ductility of the part to be press-fitted and thus a decrease in the proof stress of the main body part can be prevented and a predetermined proof stress can be secured.

The aluminum alloy diecast is made of the aluminum alloy including 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities. With respect to the aluminum alloy having such a composition, the ductility of the aluminum alloy diecast is low and a part elongated by press-fitting the joining member into the aluminum alloy diecast is likely to generate cracks without applying the heat treatment to the aluminum alloy diecast after casting. It is found that the ductility of the part to be press-fitted of the aluminum alloy diecast having this composition is higher than the ductility of the main body part and thus the aluminum alloy diecast is produced with applying the heat treatment to the part to be press-fitted and without applying the heat treatment to the main body part in which the joining member is not press-fitted in order that the part to be press-fitted where the joining member is press-fitted is unlikely to crack.

The main body part is not required to be heated at the time of producing the aluminum alloy diecast and thus the heat energy required for heating the main body part can be reduced, and at the same time, a large heat treatment furnace for heating the entire aluminum alloy diecast and a large building for arranging the heat treatment furnace can be eliminated. Depending on the heating conditions or the like of the part to be press-fitted, the main body part is not heated and thus blisters can be unlikely to be generated in the main body part even when the gas is inserted in the main body part by casting. The aluminum alloy diecast is not required to be casted by a special diecasting method such as a high vacuum diecasting method, which prevents the gas that generates blisters from being inserted in the main body part by casting, and a large vacuum device or a vacuum seal in a mold is probably eliminated. In addition, the amount of lubricating components to be used in the mold release agent that reacts with the melted metal to form gas or the amount of chip lubricant that reacts with the melted metal to form gas is not required to be reduced and thus casting troubles are unlikely to occur even when a production speed is increased. Consequently, the number of the aluminum alloy diecasts produced per hour with less defects can be probably increased. In addition, the heating to the main body part is not require and thus deformation of the main body part at the time of heating the part to be press-fitted can be reduced. Without the deformation of the main body part at the time of heating the part to be press-fitted, the jig for preventing the deformation of the main body part at the time of heating can be eliminated, and at the same time, a process of correcting the deformation of the main body part after heating can be eliminated.

According to the aluminum alloy diecast as claimed in claim 2, the following effects are exhibited in addition to the effects of the aluminum alloy diecast as claimed in claim 1. The average hardness of the part to be press-fitted is a value that is 10% or more lower than the value of the average hardness of the main body part. This allows the ductility of the part to be press-fitted to be further improved and the part to be press-fitted to be unlikely to crack while the proof stress of the main body part is being secured.

The aluminum alloy diecast as claimed in claim 3 is made of the aluminum alloy including 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities. Therefore, in the aluminum alloy diecast, the primary crystal of Al and crystals such as eutectic Si crystals other than the primary crystal of Al are formed. The larger the roundness of the crystals other than the primary crystal of Al is and the closer the roundness is to 1 (the closer to the perfect circle), the more the generation of cracks in the vicinity of the crystals other than the primary crystal of Al can be reduced. Therefore, the larger the average roundness obtained by averaging the roundness of the crystals other than the primary crystal of Al in the predetermined portion is, the more the ductility of the predetermined portion can be improved. The average roundness of the crystals other than the primary crystal of Al in the part to be press-fitted in the range of 0.02 mm to 0.5 mm in the depth from the press-fitted back surface is larger than the average roundness of the crystals other than the primary crystal of Al in the main body part in the range of 0.02 mm to 0.5 mm in the depth from the main body front surface or the main body back surface. This allows the ductility of the part to be press-fitted to be improved relative to the main body part and the part to be press-fitted to be unlikely to crack while the proof stress of the main body part is being secured relative to the part to be press-fitted.

In the aluminum alloy having the above-described composition, the ductility of the aluminum alloy diecast is low and the elongated part by press-fitting the joining member into the aluminum alloy diecast is likely to generate cracks in the elongated part without applying the heat treatment to the aluminum alloy diecast after casting. It is found that the ductility of the part to be press-fitted of the aluminum alloy diecast having this composition is higher than the ductility of the main body part and thus the aluminum alloy diecast is produced with applying heat treatment to the part to be press-fitted and without applying heat treatment to the main body part in which the joining member is not press-fitted in order that the part to be press-fitted where the joining member is press-fitted is unlikely to be cracked. As a result, effects in which the deformation and the blister generation of the main body part can be reduced by reducing the thermal influence to the main body part associated with the heating to the part to be press-fitted are exhibited.

According to the aluminum alloy diecast as claimed in claim 4, the following effects are exhibited in addition to the effects of the aluminum alloy diecast as claimed in claim 3. The average roundness of the crystals other than the primary crystal of Al in the part to be press-fitted in the range of 0.02 mm to 0.5 mm in the depth from the press-fitted back surface is 0.48 or more. This allows the ductility of the part to be press-fitted to be further improved and the part to be press-fitted to be unlikely to crack.

According to the aluminum alloy diecast as claimed in claim 5, the following effects are exhibited in addition to the effects of the aluminum alloy diecast as claimed in any one of claims 1 to 4. The press-fitted front surface or the press-fitted back surface has a melted part having a crystal structure different from that of the surrounding portion. From this, it is found that the press-fitted front surface or the press-fitted back surface is heated in a short time with a high output power so that only the outermost surface layer of the press-fitted front surface or the press-fitted back surface is melted, whereby the part to be press-fitted having high ductility relative to that of the main body part is formed. Therefore, a part of the aluminum alloy diecast having high thermal conductivity can be heated in a short time to form the part to be press-fitted, and thus the heat energy required at the time of producing the aluminum alloy diecast can be further reduced, and at the same time, effects in which the deformation and the blister generation of the main body part can be reduced by reducing thermal influence to the main body part associated with the heating to the part to be press-fitted are exhibited.

In addition, confirming the molted part allows formation of the part to be press-fitted by heating a part where the melted part is formed and a position where the part to be press-fitted is formed to be easily confirmed, and at the same time, the joining member to be press-fitted into the part to be press-fitted by using the melted part as a marker.

The diecast unit as claimed in claim 6 is a diecast unit in which the joining member is fixed in the aluminum alloy diecast as claimed in any one of claims 1 to 5. The joining member is fitted at a part where a part of the press-fitted front surface is recessed and a part of the press-fitted back surface located at the opposite side of the joining member is protruded. According to this diecast unit, the same effects as those of the aluminum alloy diecast as claimed in any one of claims 1 to 5 are exhibited.

According to the method for producing a diecast unit as claimed in claim 7, in the heating step, a part of the aluminum alloy diecast is heated and the heating is terminated when the center of the press-fitted back surface of the heated part reaches 420° C. or higher, whereby the heated part is determined as the part to be press-fitted. As described above, the ductility of the part to be press-fitted into which the joining member is press-fitted can be improved by heating while heating to the portion other than the part to be press-fitted where the joining member is not press-fitted is not being required. The effects in which the proof stress of the portion other than the part to be press-fitted can be secured, and at the same time, the deformation and the blister generation of the portion other than the part to be press-fitted associated with heating can be reduced are exhibited by not heating the portion other than the part to be press-fitted.

Depending on the conditions of the heating step, however, the ductility of the part to be press-fitted may decrease after a predetermined time has passed after the heating step and cracks may be likely to be generated at the press-fitted back surface of the part to be press-fitted when the press-fitted back surface of the part to be press-fitted causes the elongation deformation by press-fitting the joining member at the press-fitted front surface. Therefore, in the press-fitting step, the joining member is press-fitted onto the press-fitted front surface of the part to be press-fitted within a predetermined time after the heating step and the press-fitted back surface of the part to be press-fitted causes the elongation deformation. As a result, the press-fitted back surface of the part to be press-fitted can be unlikely to crack when the joining member is press-fitted.

According to the method for producing the diecast unit as claimed in claim 8, the following effects are exhibited in addition to the effects of the method for producing the diecast unit as claimed in claim 7. In the heating step, the heating time from the state where the center of the press-fitted back surface of the heated part is 50° C. or lower to 420° C. or higher is within 60 seconds and thus the thermal influence to the portions other than the part to be press-fitted formed by heating can be reduced. As a result, even when gas is involved in the heated part, effects in which blisters can be unlikely to be generated in the heated part (part to be press-fitted) and the deformation and the blister generation in the portions other than the part to be press-fitted can be reduced are exhibited. In addition, the heating time per aluminum alloy diecast can be shortened as compared with the case where the entire aluminum alloy diecast is heated for several hours and thus many products can be subjected to heat treatment with a small number of heating facilities.

DESCRIPTION OF EMBODIMENTS

Figure 1A:
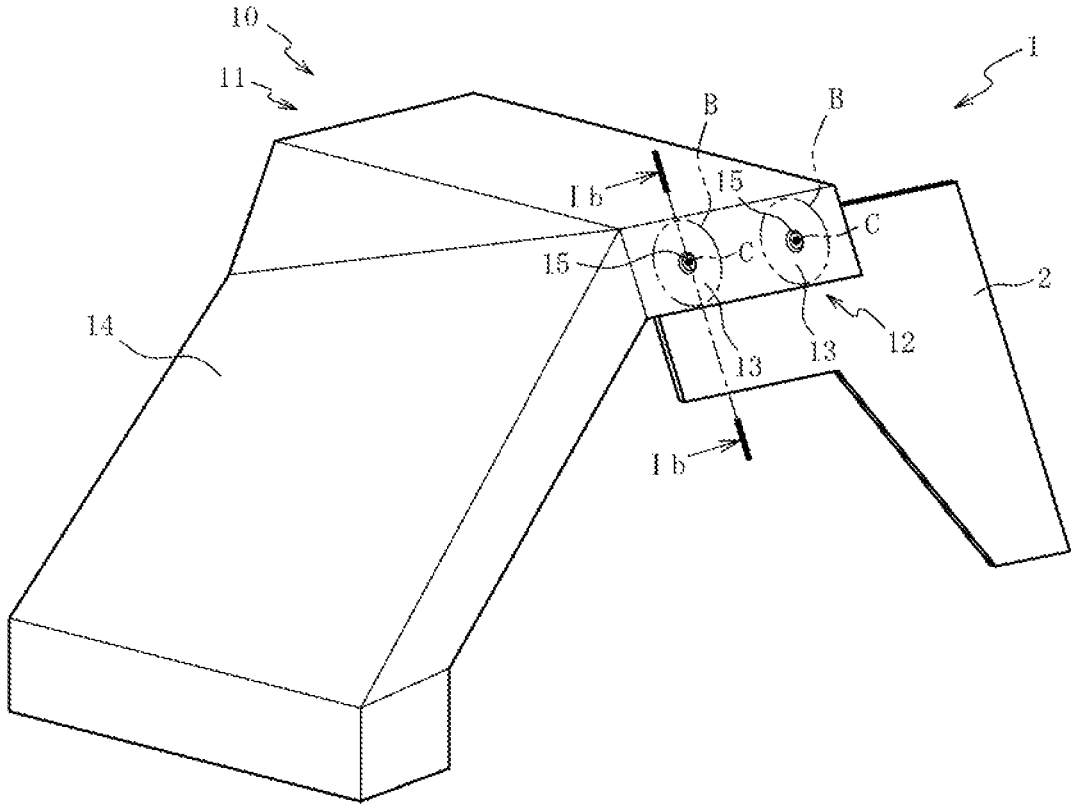
FIG. 1A is a perspective view of a joined body including a diecast unit in one embodiment and FIG. 1B is a cross-sectional view of the joined body taken along the line Ib-Ib of FIG. 1A.
Figure 1B:
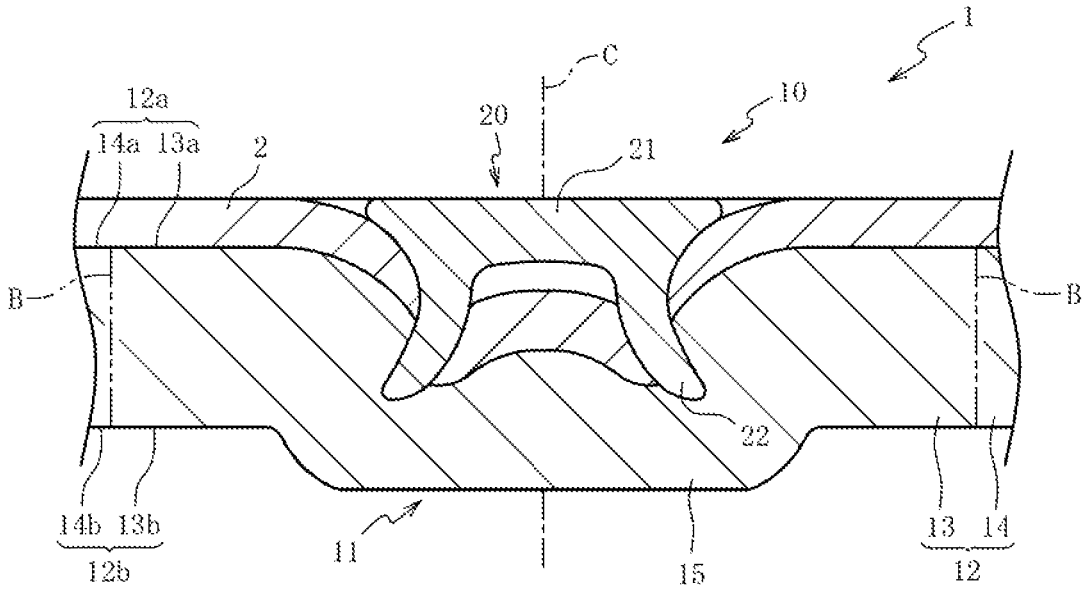
Figure 2:
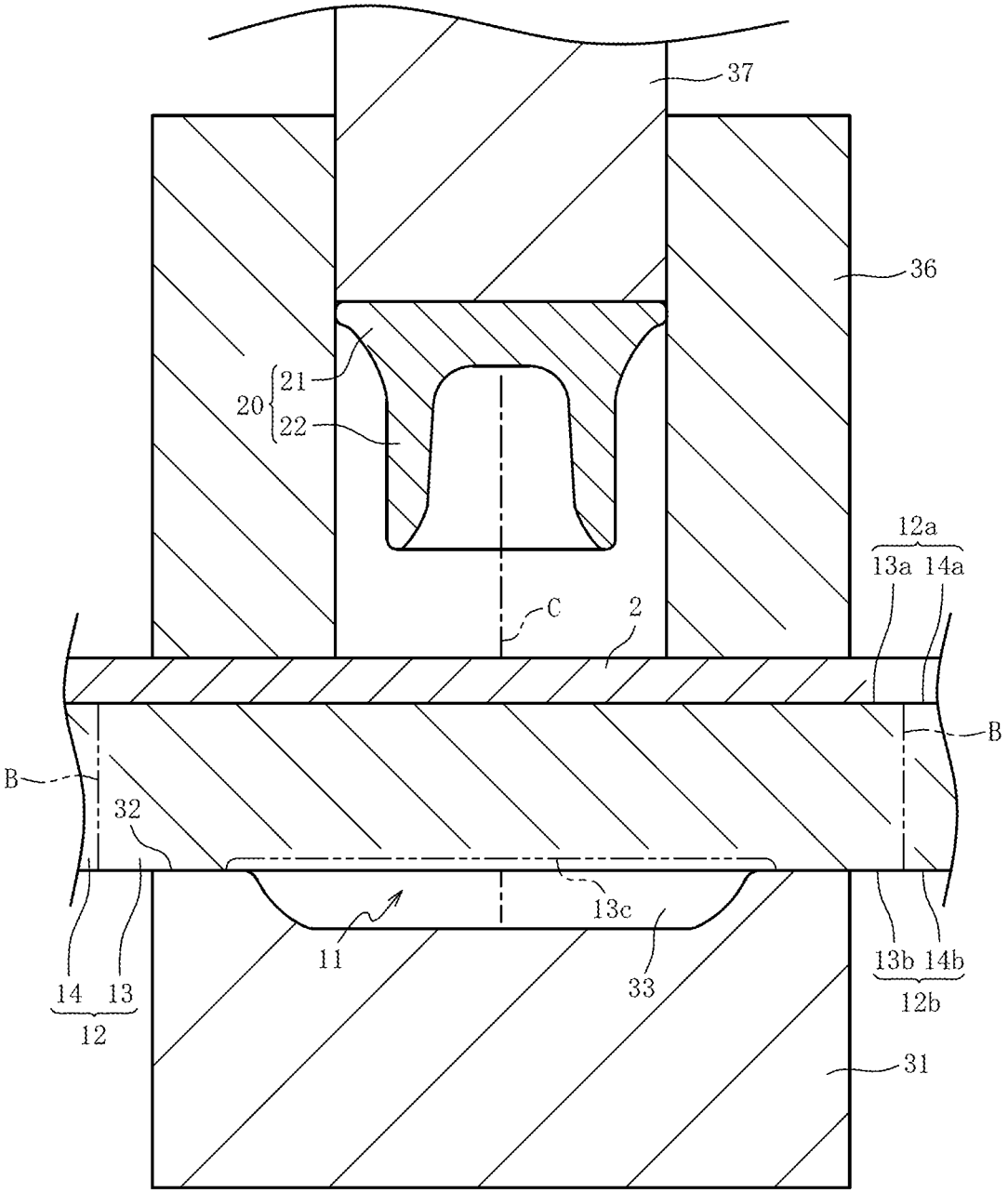
FIG. 2 is an explanatory view illustrating a method for producing the joined body.

Hereinafter, preferable embodiments of the present invention will be described with reference to the accompanying drawings. First, a joined body 1 including a diecast unit 10 in one embodiment will be described with reference to FIG. 1A and FIG. 1B. FIG. 1A is a perspective view of the joined body 1 and FIG. 1B is a cross-sectional view of the joined body 1 taken along the line Ib-Ib of FIG. 1A As illustrated in FIG. 1A. FIG. 1B and FIG. 2, the joined body 1 includes the diecast unit 10 and a counterpart member 2 fixed to the diecast unit 10. The counterpart member 2 is a member made of steel and an approximately plate-shaped portion is fixed to the diecast unit 10. The approximately plate-shaped portion of the counterpart member 2 refers to a portion having an approximately constant thickness and having both front and back surfaces formed of a flat surface, a curved surface or the like. The thickness of the approximately plate-shaped portion of the counterpart member 2 is preferably 5 mm or less.

The diecast unit 10 includes an aluminum alloy diecast 11 and a plurality of joining members 20. The aluminum alloy diecast 11 is a member made of an aluminum alloy formed by a diecasting method. This aluminum alloy includes 7.5% to 11.5% Si, 0.1% to 0.6% Mg, 0.2% to 0.9% Mn, 0.2% or less of Ti and 0.1% or less of Sr in a mass ratio and the remainder made of Al and inevitable impurities (the remainder is substantially made of Al). The term "0.2% or less of Ti" includes the case where Ti is not included at all (the case where Ti is 0%). The term "0.1% or less of Sr" includes the case where Sr is not included at all (the case where Sr is 0%).

Si of 7.5% or more allows the fluidity of the melted metal to be secured at the time of casting the aluminum alloy diecast 11. More than 11.5% of Si results in lowering the ductility of the aluminum alloy diecast 11. Mg is an element for adjusting the proof stress of the aluminum alloy diecast 11. A large amount of Mg result in lowering the ductility of the aluminum alloy diecast 11. The large amount of Mg causes Mg in the melted metal at the time of casting to be easily oxidized and thus the composition of the metal Mg in the aluminum alloy becomes difficult to control. Setting Mg to 0.6% or less allows the component control of Mg to be facilitated and the proof stress of the aluminum alloy diecast 11 to be appropriately adjusted.

Mn of 0.2% or more allows the reaction of the melted metal and a mold at the time of casting the aluminum alloy diecast 11 to be reduced. In order to reduce the reaction of the melted metal and the mold, the amount of Mn is preferably set to 0.4% or more. Mn of 0.9% or less allows the lowering of the ductility of the aluminum alloy diecast 11 caused by Mn to be reduced, and at the same time, generation of sludge during retention of the melted metal to be reduced.

Addition of 0.04% to 0.2% of Ti and 0.006% to 0.1% of Sr allows the ductility of the aluminum alloy diecast 11 to be improved. Ti lower than 0.04% and Sr lower than 0.006% are inevitable impurities and thus the inevitable impurities hardly affect physical properties of the aluminum alloy diecast 11. The inevitable impurities include Cu, Fe and Zn. In the case where the aluminum alloy diecast 11 is used for an automobile body or the like, Cu is preferably 0.2% or less, Fe is preferably 0.3% or less and Zn is preferably 0.1% or less for the purpose of corrosion resistance.

The aluminum alloy diecast 11 includes a connecting part 12 overlapped with the counterpart member 2 and a shape other than the shape of the connecting part 12 can be freely set. The connecting part 12 is formed in an approximate plate shape including a front surface 12*a* facing the counterpart member 2 and a back surface 12*b* located on the opposite side of the front surface 12*a* in the thickness direction. The approximately plate-shaped connecting part 12 refers to a connecting part having approximately constant thickness and formed from a flat surface, a curved surface or the like of the front surface 12*a* and the back surface 12*b*.

The connecting part 12 is preferably formed in a thickness of 5 mm or less. In the aluminum alloy diecast 11 made of the aluminum alloy having the above-described composition, the front surface 12*a* and the back surface 12*b* are likely to crack when the front surface 12*a* and the back surface 12*b* cause the elongation deformation, in the case where heat treatment is not applied after casting.

The joining member 20 is a member for joining the connecting part 12 and the counterpart member 2 in the aluminum alloy diecast 11 and is made of a self-piercing rivet (self-perforated rivet) in the present embodiment. The joining member 20 is made of a metal material such as steel and is suitable for joining plate-shaped members made of different materials having no prepared holes to each other.

The joining member 20 includes an approximately disk-shaped head part 21 and a cylindrical part 22 as a shaft part protruding from the head part 21 and is formed axially symmetrically with respect to an axis C. The cylindrical part 22 is a cylindrical member having a circular inner peripheral surface and outer peripheral surface in a cross-section perpendicular to the axis C. As will be described in detail below, this joining member 20 is press-fitted (driven) from the front surface 12*a* side (the connecting part 2 side) into the part where the counterpart member 2 and the connecting part 12 are overlapped, whereby the cylindrical part 22 penetrates into the counterpart member 2, and at the same time, is ingrown into the connecting part 12 while the diameter of the cylindrical part 22 is being increased toward the tip. Consequently, the joining member 20 is fixed to the counterpart member 2 and the connecting part 12.

The connecting part 12 includes the part to be press-fitted 13 into which the joining member 20 is press-fitted and a main body part 14 connected to the edge of the part to be press-fitted 13. The part to be press-fitted 13 and main body part 14 are integrally molded. In the aluminum alloy diecast 11, a portion other than the connecting part 12 is also a part of the main body part 14. In each drawing, the boundary B between the part to be press-fitted 13 and the main body part 14 is illustrated by a two-dot chain line. For convenience of explanation, the position of the boundary B between the part to be press-fitted 13 and the main body part 14 is illustrated closer to the joining member 20 in FIG. 1B and FIG. 2.

The part to be press-fitted 13 includes a press-fitted front surface 13*a* that is a part of the front surface 12*a* and into which the joining member 20 is press-fitted and a press-fitted back surface 13*b* that is a part of the back surface 12*b* and is opposite to the press-fitted front surface 13*a*. The main body part 14 includes a main body front surface 14*a* including a part of the front surface 12*a* and connected to the edge of the press-fitted front surface 13*a* and a main body back surface 14*b* including a part of the back surface 12*b* and connected to the edge of the press-fitted back surface 13*b*.

A part of the press-fitted front surface 13*a* is recessed associated with the press-fitting of the joining member 20 and a part of the counterpart member 2 and the joining member 20 is fitted into this recessed part. A part of the press-fitted back surface 13*b* located on the opposite side of the joining member 20 protrudes from the periphery thereof and a protruding part 15 having a circular outer shape in a cross-section perpendicular to the axis C is formed in the part to be press-fitted 13.

A method for producing the joined body 1 will be described with reference to FIG. 1A. FIG. 1B and FIG. 2. FIG. 2 is an explanatory view illustrating the method for producing the joined body 1. First, an aluminum alloy diecast 11 having a predetermined shape is cast and molded by a diecasting method using the melted metal of the aluminum alloy (molding step). As illustrated in FIG. 2, the front surface 12*a* and the back surface 12*b* of the connecting part 12 of the aluminum alloy diecast 11 after casting are formed of smooth surfaces having almost no unevenness.

After the molding step, a part of the connecting part 12 of the aluminum alloy diecast 11 is heated and the heating is terminated when the center of the back surface 12*b* (the intersection of the back surface 12*b* and the axis C) of the heated part reaches 420° C. or higher, whereby a part of the heated connecting part 12 is determined as the part to be press-fitted 13 (heating step). In the case where the aluminum alloy diecast 11 has a high thermal conductivity and a thickness of the connecting part 12 of 5 mm or less, the center of the heated part of the connecting part 12 is heated to an approximately uniform temperature along the thickness direction when the front surface 12*a*, the back surface 12*b* or anywhere inside in the connecting part 12 is heated. For example, the front surface 12*a* of the connecting part 12 may be externally heated and the center of the back surface 12*b* may be heated to 420° C. or higher due to the thermal influence of the external heating. In the case where the connecting part 12 having a thickness of more than 5 mm is externally heated, however, the back surface 12*b* is preferably directly heated in order to reduce heat energy and the like. The part surrounded by the boundary B in FIG. 1A and FIG. 1B is the part to be press-fitted 13 and the portion that is located outside the boundary B and of which material properties have hardly changed due to being away from the heating range is the main body part 14.

That the heating is terminated when the center of the back surface 12*b* (press-fitted back surface 13*b*) of the heated part reaches 420° C. or higher means that after the center of the press-fitted back surface 13*b* of the heated part reaches 420° C. or higher, the heating is terminated within 60 seconds so that the portion having a depth of 10 μm or more from the press-fitted front surface 13*a* or the press-fitted back surface 13*b* does not melt. In the heating step, the heated part is not required to be retained at a high temperature for a long time because the material properties in the vicinity of the part of the connecting part 12 where the joining member 20 is press-fitted may be changed. Therefore, in order to reduce the heat energy required for producing the aluminum alloy diecast 11, the heating is preferably terminated at the moment when the heated part reaches 420° C. Depending on the heating time, the heated part may be hardly melted until the temperature of the center of the press-fitted back surface 13*b* of the heated part is up to 550° C.

In the present embodiment, the connecting part 12 is heated by using light heating that projects halogen light into a part of the connecting part 12 in a circular range. Halogen light may be projected to a part of the connecting part 12 in a rectangular range to heat a place where the joining members 20 are to be arranged side by side and to be press-fitted at a time. Examples of other heating methods include laser heating by irradiating the connecting part 12 with laser light, induction heating by eddy current generated in the connecting part 12 due to electromagnetic induction, resistance heating in which a current directly flows through the connecting part 12 and contact heating by bringing a high temperature medium in contact with the connecting part 12.

The temperature at the center of the press-fitted back surface 13*b* of the heating part is calculated from a temperature rise rate and a heating time by previously measuring the temperature rise rate at the center of the test specimen relative to the output power of the heating means by embedding a thermocouple at the center of the press-fitted back surface 13*b* of the connecting part 12 serving as the test specimen. The temperature at the center of the back surface 12*b* of the heated part may also be measured with a radiation thermometer. The temperature may also be measured by placing a contact type surface thermometer may on the press-fitted back surface 13*b* of the heated part. In this case, reproducible measurement is possible by using a mechanism that keeps the contact surface pressure constant.

In the heating step, a part of the connecting part 12 may be heated for a short time. The shorter the heating time is, the more energy required for heating can be reduced. At the same time, the degree of freedom of the heating method can be improved. In addition, the entire aluminum alloy diecast 11 is not heated and thus a large heat treatment furnace for heating the entire aluminum alloy diecast 11 and a large building for arranging the heat treatment furnace can be eliminated.

In addition, depending on the heating time of the heated part (the part to be press-fitted 13), the deformation of the main body part 14 at the time of this heating can be reduced. Without the deformation of the main body part 14 at the time of heating, holding the main body part 14 at the time of heating with a jig for preventing the deformation can be eliminated, and at the same time, the process of correcting the deformation can be eliminated. Depending on the heating time of the heated part, blisters due to the heating of the heated part can be unlikely to be generated in the main body part 14 even when the gas is inserted in the main body part 14 by casting.

When the heating time from the state where the center of the press-fitted back surface 13*b* of the heated part is 50° C. or lower to 420° C. or higher is within 60 seconds and the heating time is more preferably within 20 seconds, the thermal influence to the main body part 14 can be reduced. This allows the deformation and the blister generation of the main body part 14 to be further reduced. The short heating time allows blisters to be unlikely to be generated in the heated part even when gas is involved in the heated part. The short heating time also allows the heating time per aluminum alloy diecast 11 to be shortened as compared with the case where the entire aluminum alloy diecast 11 is heated for several hours. Consequently, many products can be subjected to heat treatment with a small number of heating facilities.

Without the generation of the blister, the aluminum alloy diecast 11 is not required to be casted by a special diecasting method such as a high vacuum diecasting method so that the gas that causes blisters is not inserted in the main body part 14 by casting, and a large vacuum device or a vacuum seal in a mold can be omitted. In addition, the used amount of lubricating components in the mold release agent that reacts with the melted metal to form gas or the used amount of chip lubricant that reacts with the melted metal to form gas is not required to be reduced and thus casting troubles are unlikely to occur even when a production speed in increased. Consequently, the number of the aluminum alloy diecasts 11 produced per hour with few defects can be increased. As described above, the degree of freedom of a method for casting the aluminum alloy diecast 11 can be improved.

As illustrated in FIG. 2, in the case where a part of the back surface 12*b* of the connecting part 12 is heated by high-power laser heating so that the heating time until the center of the press-fitted back surface 13*b* of the heated part reaches 420° C. or higher is shortened, the outermost surface layer of the heated part is melted and the melted part 13*c* is formed in the heated press-fitted back surface 13*b*. The melted part 13*c* may be formed in the press-fitted front surface 13*a* by heating a part of the front surface 12*a* of the connecting part 12.

The melted part 13*c* is a portion of which crystal structure is different from that of the surrounding portion by cooling after once being melted. Depending on the heating conditions, the melted part 13*c* is whitened relative to the periphery portion. As described above, when the aluminum alloy diecast 11 after the heating step is confirmed and the melted part 13*c* having different crystal structure relative to the surrounding portion exists, formation of the part to be press-fitted 13 by heating a part of the back surface 12*b* in which the melted part 13*c* is formed by high output power in a short time can be confirmed even when the method for producing the aluminum alloy diecast 11 is not confirmed. A part of the aluminum alloy diecast 11 having high thermal conductivity can be heated in a short time to form the part to be press-fitted 13, and thus the heat energy required for producing the aluminum alloy diecast 11 can be reduced, and at the same time, the deformation and the blister generation of the main body part 14 can be reduced by reducing the thermal influence to the main body part 14 associated with the heating to the part to be press-fitted. The white melted part 13*c* is formed in the part to be press-fitted 13 into which the joining member 20 is press-fitted and thus the joining member 20 can be press-fitted into the part to be press-fitted 13 using the melted part 13*c* as a marker.

In the heating step, heating is applied to a part of the connecting part 12, whereby the heat is taken away by the part other than the heated part and the heated part is naturally air-cooled after the heating is terminated. The aluminum alloy diecast 11 has high thermal conductivity and thus the heat of the heated part is likely to be taken away by the unheated part and the heated part of the connecting part 12 can be quickly and sufficiently cooled by natural air cooling.

Subsequently, within a predetermined time after the heating step, as illustrated in FIG. 2, the joining member 20 is press-fitted from the press-fitted front surface 13*a* side into the part where the part to be press-fitted 13 and the counterpart member 2 are overlapped (press-fitting step). The cylindrical part 22 of the joining member 20 before being press-fitted into the counterpart member 2 and the part to be press-fitted 13 has an approximately constant diameter and the inner diameter of the tip side gradually increases toward the tip.

In the press-fitting step, a die 31 supporting the back surface 12*b* of the connecting part 12 from the lower side, a cylinder 36 pressing the connecting part 12 and the counterpart member 2 against the die 31 from the upper side and a punch 37 press-fitting (hitting) the joining member 20 into the counterpart member 2 and the part to be press-fitted 13 are used. The die 31 includes a round hole-shaped recessed part 33 having a bottom on the installation surface 32 on which the connecting part 12 is placed. The inner diameter of the recessed part 33 are the largest at the boundary with the installation surface 32. Appropriate values are determined to the inner diameter and depth of this recessed part 33 depending on each dimension and material of the cylindrical part 22 before being press-fitted into the counterpart member 2 and the part to be press-fitted 13 and each dimension and material of the connecting part 12 and the counterpart member 2.

In the press-fitting step, the entire recessed part 33 is closed with the press-fitted back surface 13*b* of the part to be press-fitted 13. Therefore, in the heating step, in consideration of the error of the press-fitting position of the joining member 20, a part of the connecting part 12 having a wider range than the that of recessed part 33 is heated to form the part to be press-fitted 13.

The cylinder 36 is a cylindrical member located concentrically with the recessed part 33. The cylinder 36 is arranged in the periphery of the recessed part 33 so as to face the installation surface 32. The punch 37 is a columnar member that moves in the cylinder 36 in the axial direction by a drive device that is not illustrated.

In the press-fitting step, in a state where the connecting part 12 and the counterpart member 2 are sandwiched between the cylinder 36 and the installation surface 32, the cylindrical part 22 of the joining member 20 located above the press-fitted front surface 13*a* is driven into the counterpart member 2 and the part to be press-fitted 13 using the punch 37. This allows the cylindrical part 22 to be penetrated through the counterpart member 2 having no prepared hole and the press-fitted part 13 pushed downward by the joining member 20 and the counterpart member 2 to be plastically deformed (drawing deformation) toward the bottom of the recessed part 33. The press-fitted back surface 13*b* causes the elongation deformation along the recessed part 33 and the tip of the cylindrical part 22 penetrates into the part to be press-fitted 13 with the cylindrical part 22 causing diameter-elongation deformation, while a part of the press-fitted back surface 13*b* is protruding in a circular shape to form a protruding part 15. As a result, as illustrated in FIG. FIG. 1B, the counterpart member 2 and the connecting part 12 are joined by the joining member 20 to produce the diecast unit 10 and the joined body 1.

According to the aluminum alloy diecast 11 and the diecast unit 10 produced as described above, the average hardness of the part to be press-fitted 13 obtained by averaging the Rockwell hardness HRF at four or more positions on the press-fitted back surface 13*b* heated in the heating step is lower than the average hardness of the main body part 14 obtained by averaging the Rockwell hardness HRF at four or more positions of the main body front surface 14*a* or the main body back surface 14*b*, which is not heated at the time of the heating step. Basically, the lower the average hardness is, the higher the ductility of the object is. Therefore, in the case where the joining member 20 is press-fitted onto the press-fitted front surface 13*a* of the part to be press-fitted 13 to elongate the press-fitted back surface 13*b*, the press-fitted back surface 13*b* of the part to be press-fitted 13 in which the ductility is improved relative to the main body part 14 can be unlikely to crack. The main body part 14 is not heated and thus a decrease in the proof stress of the main body part 14 due to heating can be prevented and a predetermined proof stress ca be secured.

The value of the average hardness of the part to be press-fitted 13 is 10% or more lower than the value of the average hardness of the main body part 14, that is, the rate of change in the average hardness after the heat treatment relative to the average hardness before the heat treatment by the heating step is preferably 10% or more. This allows the ductility of the part to be press-fitted 13 can be further improved and the part to be press-fitted 13 can be less likely to crack while the proof stress of the main body part 14 is being secured.

The Rockwell hardness HRF is measured in accordance with JIS Z2245: 2016 (ISO 6508-1: 2015). Specifically, the Rockwell hardness HRF is measured from the change in the depth of the depression when a spherical indenter having a diameter of 1.5875 mm (not illustrated) is pressed to the front surface 12*a* (main body front surface 14*a*) or the back surface 12*b* (press-fitted back surface 13*b* or main body back surface 14*b*) of the aluminum alloy diecast 11 or the diecast unit 10 placed on a support base (not illustrated) and the pressing load is changed from 98.07 N through 588.4 N to 98.07 N.

In the case where the Rockwell hardness HRF at each measurement position for calculating the average hardness differs from the average hardness of the part to be press-fitted 13 or the main body part 14 by 10% or more, the Rockwell hardness HRF different by 10% or more is excluded and the average hardness of the part to be press-fitted 13 and the main body part 14 is recalculated. This is because local changes in hardness due to large defects at the time of casting of the aluminum alloy diecast 11 and operational errors at the time of the measurement are excluded. In the case where some Rockwell hardness HRF are excluded and the measurement positions of the Rockwell hardness HRF are 3 or less, the measurement positions are increased and the average hardness is recalculated.

The boundary B between the part to be press-fitted 13 and the main body part 14 cannot be confirmed with the naked eye. Therefore, the measurement range of the Rockwell hardness HRF on each surface of the part to be press-fitted 13 and the main body part 14 is determined as follows and an arbitrary position within the measurement range is determined as the measurement position of the Rockwell hardness HRF. First, in the diecast unit 10 in a state where the joining member 20 is press-fitted (fixed) into the aluminum alloy diecast 11, the entire back surface 12*b* of the protruding part 15 is the press-fitted back surface 13*b*, and thus the back surface 12*b* of the protruding part 15 is determined as the measurement range of the Rockwell hardness HRF of the part to be press-fitted 13. For example, in the case where the diameter of the protruding part 15 (maximum diameter of the protruding part 15) viewed from the direction perpendicular to the axis C is about 10 mm, the Rockwell hardness HRF of the back surface 12*b* at a position about 4 mm away from the axis C is measurand and the average hardness of the part to be press-fitted 13 is calculated.

Subsequently, the measurement range of the Rockwell hardness HRF of the main body part 14 in the diecast unit 10 will be described. A part of the connecting part 12 is heated in the heating step, and thus the aluminum alloy diecast 11 at a position sufficiently away from the connecting part 12 is determined as the measurement range of the Rockwell hardness HRF of the main body part 14. In the case where the portion other than the connecting portion 12 is small or the range of the connecting part 12 is unknown, the front surface 12*a* or the back surface 12*b* of the part away from the axis C by twice or more the diameter of the protruding part 15 and the outside of the boundary B is determined as the measurement range of the Rockwell hardness HRF of the main body part 14. In the case where the protruding parts 15 are arranged side by side, a part away from a line connecting each axes C of the protruding parts 15 by twice or more the maximum diameter of the protruding parts 15 is determined as the measurement range of the Rockwell hardness HRF of the main body part 14. This is because the rectangular range of the positions where the protruding parts 15 are formed (the positions where the joining members 20 are press-fitted) may be collectively heated at the time of the heating step.

Subsequently, the measurement range of the Rockwell hardness HRF of each surface of the part to be press-fitted 13 and the main body part 14 in the aluminum alloy diecast 11 before the joining member 20 is press-fitted will be described. In this case, the center of the press-fitting position of the joining member 20 and the outer diameter dimension of the cylindrical part 22 (a part of press-fitted cylindrical part 22) of the joining member 20 before press-fitting are specified from the drawings and instructions for producing the joined body 1 and the diecast unit 10 and the marker of the press-fitting position of the joining member 20 provided in the aluminum alloy diecast 11.

The measurement range of the Rockwell hardness HRF of the part to be press-fitted 13 is determined as within a circular range where the outer dimension of the cylindrical part 22 is determined as the diameter using the center of the press-fitting position as the center point. The aluminum alloy diecast 11 at a position sufficiently away from the connecting part 12 to which the joining member 20 is to be press-fitted is determined as the measurement range of the Rockwell hardness HRF of the main body part 14. In the case where the portion other than the connecting part 12 is small or the range of the connecting part 12 is unknown, the part away from four times or more the outer diameter of the cylindrical part 22 using the center of the press-fitting position serving as the center point is determined as the measurement range of the Rockwell hardness HRF of the main body part 14. This is because the maximum diameter of the protruding part 15 is about twice the external dimensions of the cylindrical part 22.

In the case where the centers of the press-fitting positions of the joining members 20 are arranged side by side, a part away from a line connecting these centers by four times or more the outer diameter dimension of the cylindrical part 22 is determined as the measurement range of the Rockwell hardness HRF of the main body part 14. In the case where the rate of change in the average hardness of the part to be press-fitted 13 relative to the average hardness of the main body part 14 is 3% or less, a part away from the center of the press-fitting position of the joining member 20 or the line connecting the centers of the press-fitting positions of the joining members 20 by 8 times or more the outer diameter of the cylindrical part 22 is determined as the measurement range of the Rockwell hardness HRF of the main body part 14. The average hardness of the part to be press-fitted 13 is recalculated.

In the case where a white melted part 13*c* is formed on the press-fitted front surface 13*a* or the press-fitted back surface 13*b* of the part to be press-fitted 13, the range whitened by the melted part 13*c* can be determined as the measurement range of the Rockwell hardness HRF of the part to be press-fitted 13. A part away from the whitened part by twice or more the diameter of the whitened range can be determined as the measurement range of the Rockwell hardness HRF of the main body part 14.

The aluminum alloy constituting the aluminum alloy diecast 11 of the present embodiment includes 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities. In the aluminum alloy diecast 11 made of such an aluminum alloy, a primary crystal of Al and crystals other than the primary crystal of Al are formed. The larger the roundness of the crystals other than the primary crystal of Al is and the closer the roundness is to 1 (closer to the perfect circle), the more the generation of cracks in the vicinity of the crystals other than the primary crystal of Al can be reduced. Therefore, the larger the average roundness obtained by averaging the roundness of the crystals other than the primary crystal of Al in the predetermined portion is, the more the ductility of the predetermined portion can be improved. The amount of eutectic Si crystals is particularly large among the amount of the crystals other than the primary crystal of Al, and thus the larger the average roundness of at least the eutectic Si crystals in the predetermined portion, the more the ductility of the predetermined portion can be improved.

Here, a method for measuring the average roundness of the crystals other than the primary crystal of Al will be described. The measurement range of the average roundness of the crystals other than the primary crystal of Al of the part to be press-fitted 13 is approximately the same as the measurement range of the Rockwell hardness HRF of the part to be press-fitted 13. The measurement range of the average roundness of the crystals other than the primary crystal of Al of the main body part 14 is approximately the same as the measurement range of the Rockwell hardness HRF of the main body part 14 described above.

First, the part to be press-fitted 13 and the main body part 14 are cut and the cut surface is polished until the crystals other than the primary crystal of Al can be measured. Subsequently, among the polished parts, the part to be press-fitted 13 and the main body part 14 having a depth in the range of 0.02 mm to 0.5 mm from the front surface 12*a* (main body front surface 14*a*) or the back surface 12*b* (press-fitted back surface 13*b* or main body back surface 14*b*) are observed with a metallurgical microscope and two fields of view of the images of a field of view of 40 μm in length×30 μm in width are acquired for each test specimen. Image processing is performed on the image of one field of view and the peripheral lengths and areas of the crystals other than the primary crystal of Al in the field of view are measured. Therefore, the roundness of the crystals other than the primary crystal of Al represented by $(4\pi\times\text{Area})/(\text{Peripheral length})^2$ is calculated and the roundness of the crystals other than the primary crystal of Al in one field of view is averaged. The roundness of the crystals other than the primary crystal of Al averaged for each field of view is averaged in two fields of view and the average roundness of the crystals other than the primary crystal of Al of the part to be press-fitted 13 and the main body part 14 is calculated.

The average roundness of the crystals other than the primary crystal of Al of the part to be press-fitted 13 in the range of 0.02 mm to 0.5 mm in the depth from the press-fitted back surface 13*b* is larger than the average roundness of the crystals other than the primary crystal of Al of the main body part 14 in the range of 0.02 mm to 0.5 mm in the depth from the main body front surface 14*a* or the main body back surface 14*b*. The ductility of the part having a large average roundness is high and thus the part to be press-fitted 13 can be unlikely to crack by increasing the ductility of the part to be press-fitted 13 relative to that of the main body part 14 while the proof stress of the main body part 14 is being secured as compared with the part to be press-fitted 13.

The average roundness of the crystals other than the primary crystal of Al of the part to be press-fitted 13 in the range of 0.02 mm to 0.5 mm in the depth from the press-fitted back surface 13*b* is preferably 0.48 or more. This allows the ductility of the part to be press-fitted 13 to be further improved and the part to be press-fitted 13 to be less likely to crack.

The aluminum alloy constituting the aluminum alloy diecast 11 of the present embodiment includes 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities. In the aluminum alloy having such a composition, the ductility of the aluminum alloy diecast 11 is low and a part elongated by press-fitting the joining member 20 into the aluminum alloy diecast 11 is likely to generate cracks without applying heat treatment to the aluminum alloy diecast 11 after casting.

Therefore, as described above, in the case where the ductility of the part to be press-fitted 13 is higher than the ductility of the main body part 14 due to the lower average hardness of the part to be press-fitted 13 than the average hardness of the main body part 14 or the larger average roundness of the part to be press-fitted 13 than the average roundness of the main body part 14, it is found that the aluminum alloy diecast 11 is produced with applying heat treatment to the part to be press-fitted 13 and without applying heat treatment to the main body part 14 into which the joining member 20 is not press-fitted in order that the part to be press-fitted 13 where the joining member 20 is press-fitted is unlikely to crack, even when the method for producing the aluminum alloy diecast 11 is not confirmed. As a result, the above-described effects such as reducing the thermal influence to the main body part 14 associated with the heating to the part to be press-fitted 13 to reduce the deformation and the blister generation of the main body part 14 can be obtained.

Depending on the heating conditions, however, the ductility of the part to be press-fitted 13 is lowered when a predetermined time elapses after the heating step and thus cracks may be likely to be generated on the press-fitted back surface 13*b* when the press-fitted back surface 13*b* causes the elongation deformation by press-fitting the joining member 20 onto the press-fitted front surface 13*a* of the part to be press-fitted 13. Therefore, in the press-fitting step, the joining member 20 is required to be press-fitted onto the press-fitted front surface 13*a* within a predetermined time after the heating step to cause the elongation deformation of the press-fitted back surface 13*b*. As a result, the press-fitted back surface 13*b* can be unlikely to crack when the joining member 20 is press-fitted.

EXAMPLE

Hereinafter, the present invention will be specifically described with reference to Example. The present invention, however, is not limited to this Example.

(Preparation of Test Specimen)

Using melted metal of aluminum alloys having compositions listed in Table 1, a plurality of aluminum alloy diecasts 11 for each of the compositions including a connecting part 12 having a plate thickness of 3.2 mm were formed as the test specimens of alloys 1 to 7 by a high vacuum diecasting method. Each numerical value listed in Table 1 is a mass ratio (%), and in Table 1, components less than 0.01% are listed as "<0.01". In Table 1, the description of inevitable impurities of less than 0.01% and the description of Al serving as the remainder are omitted. Examples of the impurities include Ni, Cr, Pb and Sn.

TABLE 1

| | Si | Mg | Mn | Ti | Cu | Fe | Zn | Sr |
|---|---|---|---|---|---|---|---|---|
| Alloy 1 | 10.81 | 0.39 | 0.42 | 0.02 | <0.01 | 0.11 | <0.01 | <0.01 |
| Alloy 2 | 10.85 | 0.21 | 0.42 | 0.02 | <0.01 | 0.12 | <0.01 | <0.01 |

TABLE 1-continued

| | Si | Mg | Mn | Ti | Cu | Fe | Zn | Sr |
|---|---|---|---|---|---|---|---|---|
| Alloy 3 | 8.79 | 0.36 | 0.42 | 0.01 | <0.01 | 0.12 | 0.01 | <0.01 |
| Alloy 4 | 8.63 | 0.18 | 0.40 | 0.01 | <0.01 | 0.12 | 0.01 | <0.01 |
| Alloy 5 | 8.57 | 0.17 | 0.41 | 0.01 | 0.26 | 0.12 | 0.01 | <0.01 |
| Alloy 6 | 9.36 | 0.29 | 0.39 | 0.04 | 0.14 | 0.19 | 0.04 | <0.01 |
| Alloy 7 | 9.38 | 0.34 | 0.41 | <0.01 | <0.01 | 0.12 | 0.01 | 0.02 |

A part of the connecting part 12 of the alloys 1 to 5 after casting was heated at 2.5 kW using a halogen heater "HSH-160/f40" manufactured by FinTech, which emitted halogen light into a circular range (diameter 24 mm) (heating step). By this heating step, each heated part to be press-fitted 13 and each main body part 14 sufficiently away from the heated part were formed in the connecting part 12 of the alloys 1 to 5. Both thicknesses of the part to be press-fitted 13 and the main body part 14 were 3.2 nm.

In the heating step, the heating temperature (heating time) and the cooling conditions after heating varied to prepare a plurality of types of test specimens of alloys 1 to 5. About 20 seconds after the start of heating by the halogen heater, the heated part at the center of the back surface 12*b* of the connecting part 12 reached 500° C. across the entire thickness direction and thus the heating was completed within 20 seconds. This allowed the center of the back surface 12*b* of the heated part to be heated to 400° C. to 500° C. for each of the alloys 1 to 5. After the heating was completed, the test specimens were cooled by natural air cooling at room temperature of about 20° C. to about 30° C. or by water cooling using a water tank having a water temperature of about 20° C. to about 30° C. until the sample specimen became approximately the same temperature as room temperature.

After the cooling was completed (heating step), the press-fitting step was performed by overlapping the counterpart member 2 made of SPCC having a plate thickness of 1.2 mm on the press-fitted front surface 13*a* and the main body front surface 14*a* of the test specimen of the alloys 1 to 5, and press-fitting the joining member 20 onto each of the press-fitted front surface 13*a* and the main body front surface 14*a* using the die 31, the cylinder 36 and the punch 37. As the joining member 20, a self-piercing rivet having a cylindrical part 22 having a length of 5 mm and an outer diameter of 5.3 mm was used. The maximum diameter of the recessed part 33 of the die 31 was set to 10 mm and the depth of the recess part 33 was set to 1.0 mm.

After the joining member 20 was press-fitted into the test specimen, whether cracks were generated in each of the press-fitted back surface 13*b* and the main body back surface 14*b* or not was confirmed. The presence or absence of this crack was determined by a penetrant flaw detection test in which a penetrating liquid was applied to the press-fitted back surface 13*b* and the main body back surface 14*b* to penetrate the penetrating liquid into the crack, the penetrating liquid that was not penetrated into the crack was removed, and thereafter, a developing liquid was applied to the press-fitted back surface 13*b* and the main body back surface 14*b* to exude the penetrating liquid. The presence or absence of the crack in the press-fitted back surface 13*b* and the main body back surface 14*b* may be determined not only by a penetrant flaw detection test but also by an eddy current flaw detection test or an ultrasonic flaw detection test.

Cracks were generated on the main body back surface 14*b* of all the test specimens after the press-fitting step. With respect to the test specimen in which cracks were not generated on the press-fitted back surface 13*b*, the temperatures at the center of the press-fitted back surface 13*b* heated at the time of the heating step are listed in Table 2, divided into the case of water cooling and the case of natural air cooling after heating for each of the alloys 1 to 5.

TABLE 2

| | Water cooling | Natural air cooling |
|---|---|---|
| Alloy 1 | 500° C. or higher | 500° C. or higher |
| Alloy 2 | 480° C. or higher | 480° C. or higher |
| Alloy 3 | 480° C. or higher | 480° C. or higher |
| Alloy 4 | 460° C. or higher | 420° C. or higher |
| Alloy 5 | 480° C. or higher | 460° C. or higher |

From Table 2, it was found that the center of the back surface 12*b* of a part (heated part) of the connecting part 12 was heated to 420° C. or higher and thereafter naturally air-cooled to form the part to be press-fitted 13, whereby the parts to be press-fitted 13 of the alloys 1 to 5 were capable of being unlikely to crack at the time of the press-fitting step. In addition, it was found that the center of the back surface 12*b* of the heated part was heated to 460° C. or higher and thereafter cooled with water, whereby the parts to be press-fitted 13 were capable of being unlikely to crack at the time of the press-fitting step. Furthermore, it was found that when the center of the back surface 12*b* of the heated part reached 500° C. or higher, the heating was terminated, whereby the parts to be press-fitted 13 of all alloys 1 to 5 were capable of being unlikely to crack at the time of the press-fitting step regardless of the cooling method.

Some test specimens of the alloys 1 to 5 prepared and heated under the same conditions as the conditions in which cracks were not generated when the press-fitting step was performed within 16 hours from the heating step generated cracks on the press-fitted back surface 13*b* of the part to be press-fitted 13 when the press-fitting step was performed after 16 hours or more from the heating step. From this, it was found that with respect to the alloys 1 to 5, the part to be press-fitted 13 was capable of being unlikely to crack by performing the press-fitting step within 16 hours after the heating step.

(Test 2)

Subsequently, with respect to all the test specimens of the alloys 1 to 5 in which cracks were not generated at the press-fitted back surface 13*b* of the part to be press-fitted 13, the Rockwell hardness HRF at the position 4 mm from the heating center on the press-fitted back surface 13*b* and the Rockwell hardness HRF of the main body front surface 14*a* or the main body back surface 14*b* of the main body part 14 were measured. The average hardness of the main body part 14 was calculated by averaging the Rockwell hardness HRF of the main body part 14 of all the test specimens for each of the alloys 1 to 5. This average hardness can be regarded as approximately the same as the average hardness of the main body part 14 obtained by averaging the Rockwell hardness HRF at a plurality of locations of the main body part 14 in one diecast unit 10 or aluminum alloy diecast 11.

Similarly, the average hardness of the part to be press-fitted 13 was calculated by averaging the Rockwell hardness HRF at positions 4 mm from the heating center on the press-fitted back surface 13*b* of all the test specimens for each of the alloys 1 to 5. This average hardness can be regarded as approximately the same as the average hardness of the part to be press-fitted 13 obtained by averaging the Rockwell hardness HRF at a plurality of locations of the part to be press-fitted 13 of one diecast unit 10 or aluminum alloy diecast 11.

Figure 3A:
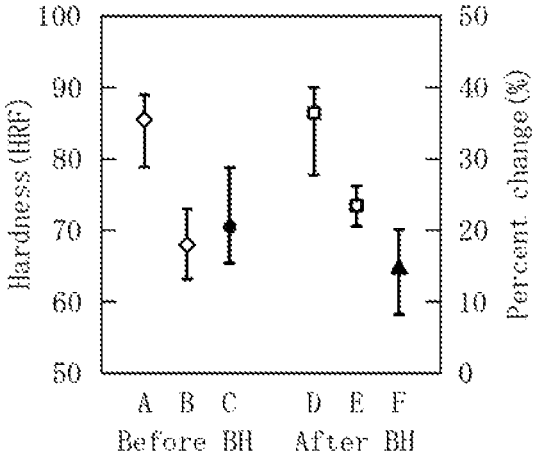
FIG. 3A is an explanatory view illustrating the hardness of each part of the aluminum alloy diecast in an alloy 1.
Figure 3B:
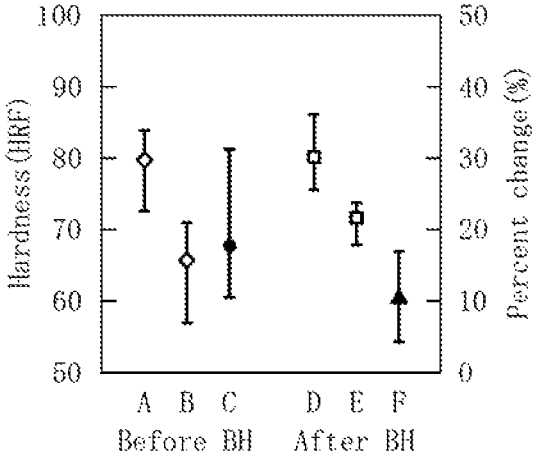
FIG. 3B is an explanatory view illustrating the hardness of each part of the aluminum alloy diecast in an alloy 2.
Figure 3C:
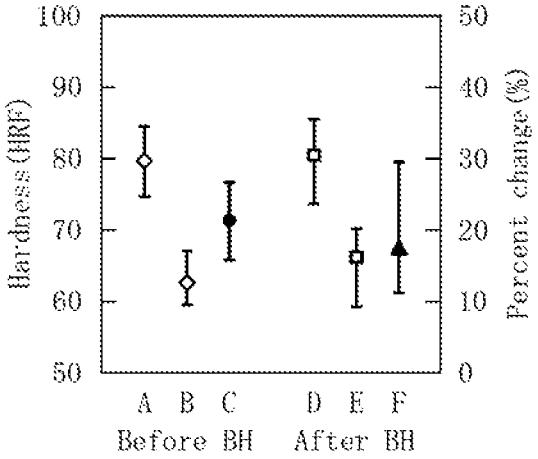
FIG. 3C is an explanatory view illustrating the hardness of each part of the aluminum alloy diecast in an alloy 3.
Figure 3D:
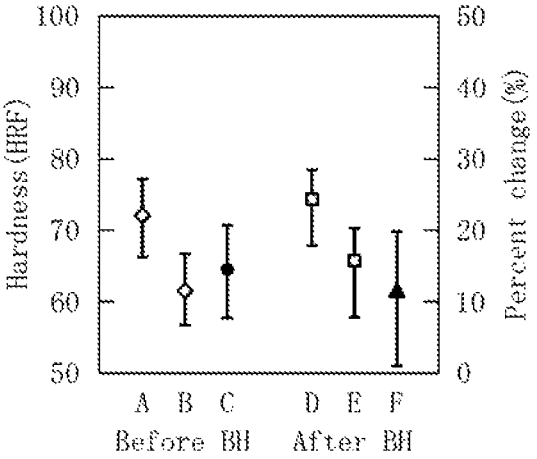
FIG. 3D is an explanatory view illustrating the hardness of each part of the aluminum alloy diecast in an alloy 4 and FIG. 3E is an explanatory view illustrating the hardness of each part of the aluminum alloy diecast in an alloy 5.
Figure 3E:
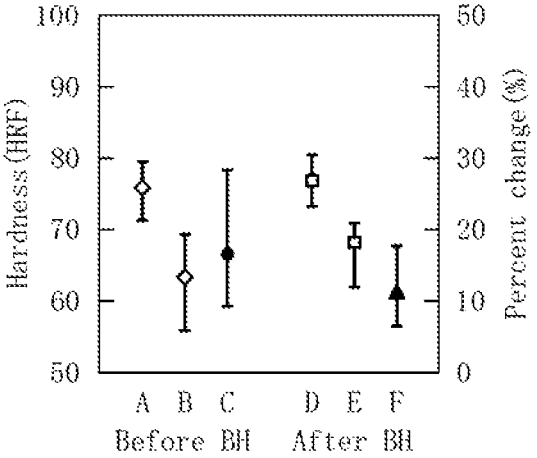

At the position A in the horizontal axis of FIG. 3A, the maximum value to minimum value of the Rockwell hardness HRF of the main body part 14 of the alloy 1 is illustrated and the average hardness of the main body part 14 is illustrated by a white square. Similarly, the maximum value to minimum value of the Rockwell hardness HRF and the average hardness of the main body part 14 is illustrated for the alloy 2 in FIG. 3B, the alloy 3 in FIG. 3C, the alloy 4 in FIG. 3D and the alloy 5 in FIG. 3E. In each graph of FIG. 3A to FIG. 3E, the first vertical axis on the left side is determined as the Rockwell hardness HRF (Hardness (HRF)).

At the position B in the horizontal axis of FIG. 3A, the maximum value to minimum value of the Rockwell hardness HRF of the part to be press-fitted 13 of the alloy 1 in which cracks were not generated is illustrated and the average hardness of the part to be press-fitted 13 in which cracks were not generated is illustrated by a white square. Similarly, the maximum value to minimum value of the Rockwell hardness HRF and the average hardness of the part to be press-fitted 13 in which cracks were not generated are illustrated for the alloy 2 in FIG. 3B, the alloy 3 in FIG. 3C, the alloy 4 in FIG. 3D and the alloy 5 in FIG. 3E.

The rate of change in the Rockwell hardness HRF of the part to be press-fitted 13 relative to the Rockwell hardness HRF of the main body part 14 ((A-B)/A) is calculated for each of the same test specimens in which cracks were not generated in the part to be press-fitted 13. The maximum value to minimum value of the rate of change in the alloys 1 to 5 is illustrated at the position C on the horizontal axis in FIG. 3A to FIG. 3E and the average of the rates of change of alloys 1 to 5 is indicated by black circles. In each graph of FIG. 3A to FIG. 3E, the second vertical axis on the right side is determined as the rate of change (Percent change (%)). In each of the alloys 1 to 5, the average of the rates of change is approximately the same as the rate of change of the average hardness of the part to be press-fitted 13 relative to the average hardness of the main body part 14.

With reference to the test results illustrated in FIG. 3A to FIG. 3E, when the average hardness of the connecting part 12 (main body part 14) illustrated in A was 72 HRF or more, cracks were generated in the connecting part 12 at the time of the press-fitting step, whereas the average hardness of the connecting part 12 (part to be press-fitted 13) illustrated in B was 68 HRF or less, cracks were not generated in the connecting part 12 at the time of the press-fitting step.

From these results, it was found that the part to be press-fitted 13 was capable of being unlikely to crack at the time of the press-fitting step by lowering the average hardness of the part to be press-fitted 13 that caused the elongation deformation at the time of the press-fitting step as compared with the average hardness of the main body part 14. It was further found that when the average hardness of the part to be press-fitted 13 was 14% or more lower than the average hardness of the main body part 14 (when the average of the rates of change is 14% or more), the part to be press-fitted 13 was capable of being unlikely to crack at the time of the press-fitting step. It was further found that when the rate of change in the average hardness of the part to be press-fitted 13 relative to the average hardness of the main body part 14 was 22% or more, the part to be press-fitted 13 was capable of being unlikely to crack at the time of the press-fitting step.

The more the amounts of additives other than Al such as Si and Mg were, the higher the average hardness of the part to be press-fitted 13 and the main body part 14 was. Therefore, it was found that the strength of the connecting part 12 of the aluminum alloy diecast 11 was capable of being improved by increasing the amount of additives such as Si and Mg in the composition range of the aluminum alloy in the above-described embodiment.

In the composition range of the aluminum alloy in the above-described embodiment, the larger the amount of Si was, the higher the average hardness that did not generate cracks in the part to be press-fitted 13 was and the larger the amount of Mg was, the larger the rate of change in the average hardness was. In other words, even when the amount of Mg was increased, the degree of difficulty to crack in the part to be press-fitted 13 did not change much.

On the contrary, it was found that, by increasing the mass ratio of Si, the joining member 20 was capable of being unlikely to come off by improving the strength in the vicinity of the part to be press-fitted 13 while the part to be press-fitted 13 was being unlikely to crack relative to the main body part 14. Therefore, in the diecast unit 10 using an aluminum alloy having a mass ratio of Si of 10.0% or more, the joining member 20 was capable of being unlikely to come off while the part to be press-fitted 13 was capable of being sufficiently unlikely to crack.

Subsequently, the test specimens of the alloys 1 to 5 after the press-fitting step were heated at 170° C. for 20 minutes, imitating bake-hard treatment performed in the painting process of automobile production lines. For the test specimen after this bake-hard treatment, the Rockwell hardness HRF of the part to be press-fitted 13 and the main body part 14 was also measured, the average hardness of each of the test specimens was calculated, and the rate of change of each test specimens was calculated. The maximum value to minimum value of the Rockwell hardness HRF of the main body part 14 after the bake-hard treatment (After BH) is illustrated at position D in the horizontal axis of FIG. 3A to FIG. 3E and the average hardness of the main body part 14 after the bake-hard treatment is illustrated by a white square.

At position E in the horizontal axis of FIG. 3A to FIG. 3E, the maximum value to minimum value of the Rockwell hardness HRF of the part to be press-fitted 13 after the bake-hard treatment is illustrated and the average hardness of the part to be press-fitted 13 is illustrated by a white square. The maximum value to minimum value of the rate of change ((D-E)/D) after the bake-hard treatment is illustrated at position F in the horizontal axis of FIG. 3A to FIG. 3E and the average of the rates of change is illustrated by a black triangle. In A to C in FIG. 3A to FIG. 3E, the hardness and the rate of change of each part before the bake-hard treatment (Before BH) are illustrated.

After the bake-hard treatment, the average hardness of the main body part 14 did not change much and the average hardness of the part to be press-fitted 13 became higher than that before the bake-hard treatment. Therefore, in the case where the diecast unit 10 after the bake-hard treatment was confirmed and the rate of change of the average hardness of the part to be press-fitted 13 relative to the average hardness of the main body part 14 was 10% or more, the part to be press-fitted 13 was unlikely to crack at the time of the press-fitting step before the bake-hard treatment.

(Test 3)

Subsequently, in the same manner as in Test 1, the joining member 20 was press-fitted into the respective part to be press-fitted 13 and main body part 14 of the test specimens of the alloys 6 and 7 heated under various conditions and whether cracks were generated or not in the press-fitted back surface 13*b* and the main body back surface 14*b* was confirmed. In addition, with respect to the test specimens of the alloys 6 and 7, the average roundness of the crystals other than the primary crystal of Al of respective part to be press-fitted 13 and the main body part 14 was measured by using image processing software "PhotoImpact 8" manufactured by ULEAD Systems. The measurement was performed by the method as described in the above embodiment.

Table 3 lists the relationship between the average roundness of the crystals other than the primary crystal of Al of the part to be press-fitted 13 and the main body part 14 and the presence or absence of cracks in the press-fitted back surface 13*b* and the main body back surface 14*b*. With respect to the heading "Crack" in Table 3, "o" represents that the press-fitted back surface 13*b* and the main body back surface 14*b* did not generate cracks and "x" represents that the press-fitted back surface 13*b* and the main body back surface 14*b* generated cracks. The average roundness of the crystals other than the primary crystal of Al of the part to be press-fitted 13 changed depending on the heating conditions when the part to be press-fitted 13 was formed.

TABLE 3

| | | Average roundness | Cracks |
|---|---|---|---|
| Alloy 6 | Part to be press-fitted | 0.38 | x |
| | | 0.48 | o |
| | | 0.66 | o |
| | | 0.52 | o |
| | | 0.54 | o |
| | Main body part | 0.35 | x |
| | | 0.42 | x |
| | | 0.31 | x |
| Alloy 7 | Part to be press-fitted | 0.53 | o |
| | Main body part | 0.38 | x |

With respect to the alloy 6, the value of the average roundness of the crystals other than the primary crystal of Al of the part to be press-fitted 13 that was not cracked was 0.48 to 0.66, whereas the value of the average roundness of the crystals other than the primary crystal of Al of the main body part 14 that was cracked was 0.31 to 0.42. With respect to the alloy 7, the value of the average roundness of the crystals other than the primary crystal of Al of the part to be press-fitted 13 was 0.53, whereas the value of the average roundness of the crystals other than the primary crystal of Al of the main body part 14 was 0.38. As described above, the average roundness of the crystals other than the primary crystal of Al of the part to be press-fitted 13 that did not crack when the joining member 20 was press-fitted was larger than the average roundness of the crystals other than the primary crystal of Al of the main body part 14. In particular, when the average roundness of the crystals other than the primary crystal of Al of the part to be press-fitted 13 was 0.48 or more, the part to be press-fitted 13 was capable of being unlikely to crack.

Although the present invention has been described above with reference to the embodiments and Example, the present invention is not limited to the above-described embodiments and above-described Example. It is easily inferred that various improvements and modifications can be made without departing from the spirit of the present invention. For example, the thickness and shape of the connecting part 12, the shape of the aluminum alloy diecast 11 other than the connecting part 12, the dimension and shape of each part of the counterpart member 2 and the joining member 20 may be appropriately changed. A plurality of pieces of the counterpart member 2 which are overlapped and joined to the connecting part 12 may be used. The joining member 20 may be press-fitted onto the press-fitted front surface 13*a* of the part to be press-fitted 13 in a state where the counterpart member 2 is not overlapped with the connecting part 12. In this case, the counterpart member 2 can be, for example, spot welded to the joining member 20. The heating step may be performed so that the entire connecting part 12 becomes the part to be press-fitted 13.

In the above-described embodiments and Example, the case where the joining member 20 is the self-piercing rivet has been described, but the present invention is not necessarily limited thereto. The joining member may be a member that is press-fitted onto the press-fitted front surface 13*a* of the aluminum alloy diecast 11 in order to join the aluminum alloy diecast 11 and the counterpart member 2, and at the time of this press-fitting, the press-fitted back surface 13*b* causes the elongation deformation. Examples of the joining member other than the self-piercing rivet include FDS (registered trademark) and RIVTAC (registered trademark) for press-fitting a rod-shaped member instead of the cylindrical part 22 and a piercing nut and a press-fitting nut having an internal thread part. After the pierce nut or the press-fit nut is fixed to the aluminum alloy diecast 11, these nuts allow the counterpart member 2 to be joined to the aluminum alloy diecast 11 through a bolt or the like attached to the internal thread part.

The counterpart member 2 may be fixed to the part to be press-fitted 13 by clinching joining in which the counterpart member 2 is overlapped with the press-fitted front surface 13*a* and a part of the counterpart member 2 is press-fitted onto the press-fitted front surface 13*a*. In this case, a part of the counterpart member 2 press-fitted onto the press-fitted front surface 13*a* is determined as the joining member.

In the above-described embodiment and Example, the conditions of the average hardness and the average roundness that allows the press-fitted back surface 13*b* of the part to be press-fitted 13 to be unlikely to crack, which are suitable in the case where the joining member 20 is a self-piercing rivet, are described. In the case where a joining member other than the self-piercing rivet is used, the optimum conditions for allowing the press-fitted back surface 13*b* to be unlikely to crack may be appropriately changed.

In the above-described embodiment, the back surface 12*b* of the protruding part 15 that causes the elongation deformation at the time of press-fitting the joining member 20 is determined as the measurement range of the Rockwell hardness HRF of the part to be press-fitted 13 so that the self-piercing rivet serving as the joining member 20 is suitable for the diecast unit 10 press-fitted into the aluminum alloy diecast 11. In the case where a joining member other than the self-piercing rivet is used, a part of the back surface 12*b* that causes the elongation deformation when the joining member 20 is press-fitted may be narrow and this part may not be suitable as a measurement range for the Rockwell hardness HRF. In this case, the back surface 12*b* at a position as close as possible to the part causing the elongation deformation at the time of press-fitting the joining member 20 is determined as the measurement range of the Rockwell hardness HRF of the part to be press-fitted 13.

In the above-described embodiment, the case where the bottom of the recessed part 33 of the die 31 is flat and the tip part (lower end face of FIG. 1B) of the protruding part 15 is flat is described. The present invention, however, is not necessarily limited to this case. The vicinity of the axis C of the protruding part 15 may be recessed by providing a conical or truncated cone-shaped protrusion at the center of the bottom of the recessed part 33.

In the above-described embodiment, in the case where the aluminum alloy diecast 11 made of the aluminum alloy including 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities has been described. The aluminum alloy, however, is not necessarily limited to this composition. The aluminum alloy diecast 11 may also be formed of an aluminum alloy outside the above-described composition range.

DESCRIPTION OF REFERENCE NUMERALS

10: diecast unit
11: aluminum alloy diecast
13: part to be press-fitted
13*a*: press-fitted front surface
13*b*: press-fitted back surface
13*c*: melted part
14: main body part
14*a*: main body front surface
14*b*: main body back surface
20: joining member

The invention claimed is:

1. An aluminum alloy diecast made of an aluminum alloy comprising 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities, the aluminum alloy diecast comprising:

a part to be press-fitted having a press-fitted front surface onto which a joining member is press-fitted and a press-fitted back surface located at an opposition side of the press-fitted front surface; and a main body part having a main body front surface connected to an edge of the press-fitted front surface and a main body back surface connected to an edge of the press-fitted back surface and integrally formed with the part to be press-fitted, wherein an average hardness of the part to be press-fitted obtained by averaging Rockwell hardness HRF of the press-fitted back surface is lower than an average hardness of the main body part obtained by averaging Rockwell hardness HRF of the main body front surface or the main body back surface, and wherein the press-fitted front surface or the press-fitted back surface comprises a melted part having a different crystal structure relative to surrounding portion.

2. The aluminum alloy diecast according to claim 1, wherein the average hardness of the part to be press-fitted is a value 10% or more lower than a value of the average hardness of the main body part.

3. A method for producing a diecast unit in which the joining member is fixed to the aluminum alloy diecast according to claim 1, the method comprising:

a heating step of heating a part of the aluminum alloy diecast and terminating the heating when a center of a press-fitted back surface opposite to the press-fitted front surface in the heated part reaches 420° C. or higher to determine the heated part as a part to be press-fitted; and a press-fitting step of press-fitting the joining part onto the press-fitted front surface of the part to be press-fitted within a predetermined time after the heating step to cause elongation deformation of the press-fitted back surface of the part to be press-fitted.

4. The method for producing the diecast unit according to claim 3, wherein in the heating step, a heating time from a state where the center of the press-fitted back surface of the heated part is 50° C. or lower to 420° C. or higher is within 60 seconds.

5. An aluminum alloy diecast made of an aluminum alloy comprising 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities, the aluminum alloy diecast comprising:

a part to be press-fitted having a press-fitted front surface onto which a joining member is press-fitted and a press-fitted back surface located at an opposition side of the press-fitted front surface; and a main body part having a main body front surface connected to an edge of the press-fitted front surface and a main body back surface connected to an edge of the press-fitted back surface and integrally formed with the part to be press-fitted, wherein an average roundness of crystals other than a primary crystal of Al in the part to be press-fitted in a range of 0.02 mm to 0.5 mm in a depth from the press-fitted back surface is larger than an average roundness of crystals other than a primary crystal of Al in the main part in a range of 0.02 mm to 0.5 mm in a depth from the main body front surface or the main body back surface.

6. The aluminum alloy diecast according to claim 5, wherein the average roundness of the crystals other than the primary crystal of Al in the part to be press-fitted in a range of 0.02 mm to 0.5 mm in a depth from the press-fitted back surface is 0.48 or more.

7. A diecast unit comprising a joining member fixed to an aluminum alloy diecast, the aluminum alloy diecast made of an aluminum alloy comprising 7.5% to 11.5% of Si, 0.1% to 0.6% of Mg, 0.2% to 0.9% of Mn, 0.2% or less of Ti and 0.1% or less of Sr in a mass ratio and a remainder made of Al and inevitable impurities, the aluminum alloy diecast comprising:

a part to be press-fitted having a press-fitted front surface onto which the joining member is press-fitted and a press-fitted back surface located at an opposition side of the press-fitted front surface; and a main body part having a main body front surface connected to an edge of the press-fitted front surface and a main body back surface connected to an edge of the press-fitted back surface and integrally formed with the part to be press-fitted, wherein an average hardness of the part to be press-fitted obtained by averaging Rockwell hardness HRF of the press-fitted back surface is lower than an average hardness of the main body part obtained by averaging Rockwell hardness HRF of the main body front surface or the main body back surface, wherein the joining member is fitted in a part where a part of the press-fitted front surface is recessed and a part of the press-fitted back surface located at an opposite side to the joining member is protruded.

8. The aluminum alloy diecast according to claim 7, wherein the average hardness of the part to be press-fitted is a value 10% or more lower than a value of the average hardness of the main body part.

* * * * *